United States Patent [19]

Fustier et al.

[11] 4,108,650

[45] Aug. 22, 1978

[54] PROCESS FOR THE PREPARATION OF MOLYBDENUM BASED ALLOYS WITH SOLID REINFORCING ELEMENTS BY SINTERING

[75] Inventors: Géraud Fustier, Bonneville; Jean-Paul Langeron, Chatenay Malabry; Joseph de la Bastie; Jean Carlizza, both of Le Fayet, all of France

[73] Assignee: Cime Bocuze, Paris, France

[21] Appl. No.: 679,823

[22] Filed: Apr. 23, 1976

[30] Foreign Application Priority Data

Apr. 23, 1975 [FR] France ..... 75 13489

[51] Int. Cl.[2] ..... B22F 3/14

[52] U.S. Cl. ..... 75/206; 75/84; 75/211; 75/234; 75/235; 75/245

[58] Field of Search ..... 75/211, 207, 84, 206, 75/235, 234, 245

[56] References Cited

U.S. PATENT DOCUMENTS

| | | | |
|---|---|---|---|
| 1,082,933 | 12/1913 | Coolidge | 75/207 X |
| 1,720,000 | 7/1929 | Ramage | 75/207 X |
| 1,822,720 | 9/1931 | Wyman | 75/211 X |
| 2,470,790 | 5/1949 | Price | 72/211 X |

*Primary Examiner*—Richard E. Schafer

*Attorney, Agent, or Firm*—Dennison, Dennison, Meserole & Pollack

[57] ABSTRACT

A process for the preparation by sintering of molybdenum based alloys containing at least one reinforcing element, characterized in that at least one addition compound is introduced in the solid state into molybdenum used in the form of at least one of the components of the group consisting of the salts of molybdenum and the oxides of molybdenum, and that carbon is then added in sufficient quantity and the intimate mixture, after reduction of the molybdenum based component, is sintered at a temperature at which the said carbon at least partially reduces the addition compound.

Addition compounds belonging to the group consisting of the mineral and organic compounds of titanium, zirconium, hafnium, thorium, aluminum, niobium, beryllium, boron and the rare earths are used.

4 Claims, 1 Drawing Figure

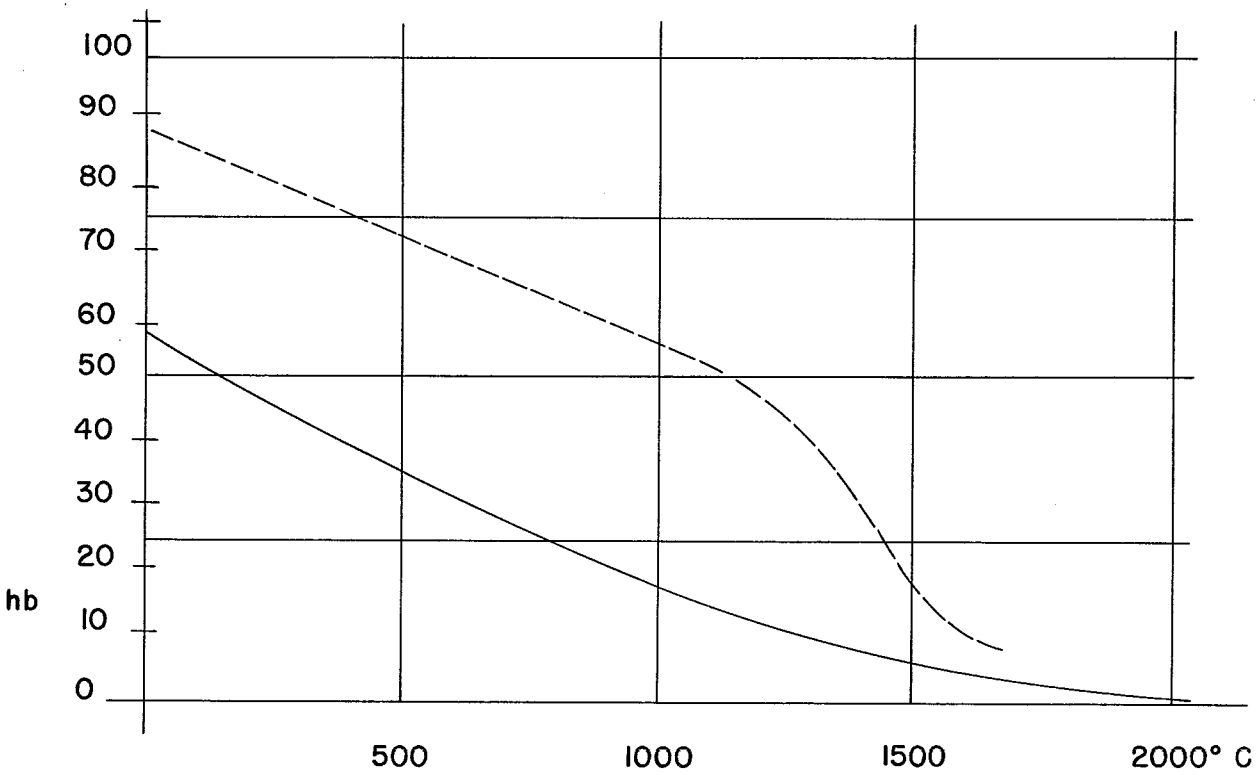
100
90
80
70
60
50
40
30
20
10
0
hb
500
1000
1500
2000° C

PROCESS FOR THE PREPARATION OF MOLYBDENUM BASED ALLOYS WITH SOLID REINFORCING ELEMENTS BY SINTERING

This invention relates to a new process for the preparation of molybdenum based alloys containing solid reinforcing elements by sintering.

The term reinforcing elements as used herein means any elements capable of being introduced intimately into molybdenum which constitutes the main element of the alloy. Thus, for example, in TZM type molybdenum based alloys, which are well known to those skilled in the art, the reinforcing elements are titanium and zirconium present in proportions of 0.5% of Ti and 0.07% to 0.1% of Zr and carbon present in proportions of from 0.01% to 0.05%.

For a long time now those conversant in the art have attempted to devise practical methods of preparing molybdenum based alloys containing reinforcing elements such as, for example, titanium, zirconium and carbon because of the vast fields of application envisaged and found for such alloys by virtue of their particularly interesting properties. It is particularly their excellent properties of resistance to high temperatures such as their sustained hardness and rigidity, low deformation under load, fatigue resistance, resistance to chemical agents and high resistance in contact with melting metals which have led the art first to envisage and then to realize their introduction into very diverse fields of application. These include, for example, the construction of certain furnaces operating under atmospheric or vacuum conditions; the use of the alloys as material for the construction of plugs and dies used for pressure casting metals, isothermal extrusion and forging, the construction of turbines, the aerospace field, etc.

Numerous processes for the preparation of these alloys by melting and by sintering have already been proposed. One of these consisted of intimately melting the components. Although this method had certain advantages, such as the possibility of controlling the balance between carbon and oxygen in the molten material, it also had major disadvantages which manifested themselves in the coarse structure of the alloy and the difficulties to be overcome in the conversion of the alloy into semi-finished and finished products. Moreover, this type of process required high investment outlay and entailed a very high cost.

It was also proposed to produce these alloys by sintering. These processes were carried out using a molybdenum powder to which were added an intimate mixture of the necessary quantities of addition compounds such as zirconium oxide or hydride, titanium hydride and carbon black. The mixture was then put under pressure of from 1 to 5 tons per square centimeter and the briquette obtained was sintered at about 2200° C. The densities obtained after sintering were between 93% and 96% of the theoretical densities. If this second method appeared promising, it nevertheless had major disadvantages giving rise to anomalies which those in the art could not easily accept. These include, for example, the imperfect dispersion of the granular hydrides in molybdenum powder when the mixture is being prepared, this imperfect dispersion persisting in the finished product. They also include the lack of fineness of subdivision of the reinforcing elements in the original mixture, a feature which also explains the imperfect dispersion mentioned above.

In addition, however, there were even more disturbing phenomena which could be attributed to the structure of certain addition compounds. Thus, for example, due to the rapid decomposition of titanium and zirconium hydrides under heat treatment, the metals reacted with the occluded gases, particularly with nitrogen, giving rise to nitrides which remained in the finished product. This difficulty of controlling the mechanism of decomposition of the hydrides gave rise to the poor control of the final carbon content.

The defects of the known manufacturing processes were thus exhibited in the fact that the qualities of the molybdenum based alloys were not fully brought out or even deleteriously affected by the poor distribution of the reinforcing elements, the formation of nitrides, etc. The alloys obtained by the processes described above were therefore not accurately reproducible from one manufacturing operation to another.

As a result of research carried out in the light of the prior art and its disadvantages and insufficiencies, the inventors have found and put into practice a process for the preparation by sintering of alloys based on molybdenum which contain reinforcing elements and are free from the defects mentioned above.

According to the invention, the process for the preparation by sintering of molybdenum based alloys containing reinforcing elements is characterized by the fact that at least one addition compound is introduced in the solid state into molybdenum used in the form of at least one of the components taken from the group consisting of molybdenum salts and molybdenum oxides, carbon is then added in sufficient quantity, and after reduction of the molybdenum based compound the intimate mixture is sintered at a temperature at which the carbon at least partially reduces the addition compound.

The preparatory part of the process according to the invention consists in broad outline of intimately mixing the basic element, which is molybdenum used in the form of at least one of its salts or oxides, with at least one addition compound introduced in the form of a solid.

The said compound is generally taken from the group consisting of mineral acid salts and organic compounds of titanium, zirconium, hafnium, thorium, niobium, beryllium, boron and the rare earths.

In all cases the addition compound is in the form of an oxide or any of the known forms of acid salts or esters which readily decompose to give rise to the corresponding oxide directly by elevation of the temperature.

However, the addition compound or compounds may be introduced at various phases of the transformation of the mixture, depending on the form in which the molybdenum is put into the process, for example whether as a salt or mixture of salts, an oxide or mixture of oxides or even in the metallic state.

If molybdenum, the base element, is in a solid state, for example in the form of at least one salt, the addition compound may be introduced into the molybdenum salt before the salt has been reduced to the oxide and then the metal. Similarly, if molybdenum is in the form of at least one of its oxides, the addition compound may be introduced at the level of the oxide without thereby changing the qualities of the alloy.

Thus, when starting from at least one molybdenum salt, the addition compound may be added either to the salt itself or to the oxide obtained after reduction of the salt.

The process is very simple to put into practice. If, for example, molybdenum is put into the process in the form of at least one of its salts, the base element in the form of a powder is intimately mixed with the solid addition compound in an agitated mixing apparatus. The molybdenum salt is then reduced to metallic molybdenum by a treatment combining the use of a reducing agent such as hydrogen at elevated temperature. The addition compound is then found to be decomposed to the state of an oxide evenly dispersed in the base element.

The carbon used for reducing the addition compound is introduced in sufficient quantity into the mixture so that the addition compound will be at least partially reduced to the metallic state and so that this portion will be completely dissolved in molybdenum during the sintering operation.

The carbon may be introduced into the mixture before reduction of the molybdenum salt but it may equally well be introduced into the said mixture when reduction of the molybdenum salt is already very advanced, either to the stage of molybdenum oxide or even to metallic molybdenum. The carbon is intimately mixed with the other elements and compounds in the agitated mixer, according to the known various ways in which the carbon may be introduced.

The briquettes from the powder mixtures obtained by the process according to the invention are produced by the usual methods employed in powder metallurgy, using mechanical or isostatic compression.

The sintering process in the course of which the addition compound is at least partially reduced to metal and this metal is dissolved in molybdenum is carried out at temperatures starting from 1800° C, which is lower than the temperature generally employed.

The sintered products according to the process of the invention appear remarkably homogeneous under a microscope.

EXAMPLE 1

A molybdenum alloy containing titanium and zirconium was prepared by the process according to the invention.

One hundred kg of ammonium decamolybdate was introduced into a mixing apparatus of known type which was already in operation, and 60 grams of $ZrO_2$ and 500 grams of $TiO_2$ were then added.

When an intimate mixture had been obtained by mixing for 15 minutes, the molybdenum salt was reduced by hydrogen at 500° C.

The powder thus obtained was returned to the mixer into which were introduced 2.5% by weight of carbon, based on the weight of reduced molybdenum powder containing the addition compounds. The resulting mother mixture was then mixed under the same conditions with the remainder of the powder so that it constituted 10% of the total weight, thereby adjusting the final carbon content to 0.25%.

Briquettes were then produced by compression at 1000 bars, and these were sintered at a temperature of 1800° C in a continuous furnace for 10 hours to ensure complete reduction of titanium oxide and solution of the titanium in molybdenum.

The quality of the sintered alloys is remarkable and examination under the microscope showed that the titanium had completely dissolved while zirconium oxide appeared as a very weakly dispersed phase.

EXAMPLE 2

A molybdenum alloy containing titanium and thorium was prepared by the process according to the invention.

One hundred kg of ammonium decamolybdate were introduced into a known mixing apparatus which was already in operation and 200 grams of thorium nitrate and 500 grams of $TiO_2$ were then added. After continuous mixing for 15 minutes giving rise to an intimate mixture, the molybdenum salt was reduced by hydrogen at 500° C.

The resulting powder was returned to the mixer into which were introduced 2.5% by weight of carbon, based on the weight of the reduced molybdenum powder containing the addition compounds. The mother mixture thus obtained was mixed under the same conditions with the remainder of the reduced powder so that it amounted to 10% by weight of the total to adjust the final carbon content to 0.25%.

Briquettes were then produced by compression at 1000 bars. These were sintered at a temperature of 1800° C in a continuous furnace for 10 hours to ensure complete reduction of titanium oxide and solution of titanium in the molybdenum.

The quality of the sintered alloys was excellent and microscopic examination showed that the titanium had completely dissolved while the thorium oxide appeared as a very weakly dispersed phase.

The alloys produced by the process according to the invention show exceptionally high rupture strength in the heat, very superior to that of pure molybdenum obtained by the metallurgy of powders.

For a molybdenum based alloy containing 0.5% of titanium and 0.08% of zirconium, the rupture strength in *h* bar up to 1500° C is at least twice the rupture strength of pure molybdenum at the same temperature, as can be seen from the FIGURE where the broken line graph represents the rupture strength of the aforesaid alloy up to 1700° C while the full line graph represents the rupture strength of molybdenum up to 200° C.

We claim:

1. A process for the preparation of molybdenum based alloys containing titanium and zirconium, or titanium and thorium, as reinforcing elements, comprising, (a) introducing into molybdenum used in the form of ammonium decamolybdate, zirconium oxide and titanium oxide or thorium nitrate and titanium oxide, as addition compounds, all in the solid state, (b) mixing the ammonium decamolybdate and addition compounds to obtain an intimate mixture, (c) reducing the ammonium decamolybdate in the mixture to metallic molybdenum, by hydrogen at about 500° C, (d) adding and mixing carbon in sufficient quantity to at least partially reduce the addition compounds to the metallic state, (e) compressing the (d) mixture at a pressure of about 1000 bars to form briquettes, and (f) sintering the briquettes at a temperature at which the said carbon completes the reduction of the titanium oxide and solution thereof in the molybdenum, while the zirconium oxide or thorium oxide appears as a dispersed phase.

2. A process as defined in claim 1 wherein the molybdenum based alloy contains about 0.5% of titanium, about 0.08% zirconium, and a carbon content of about 0.25%.

3. A process as defined in claim 1 wherein the alloy is prepared from about 100 kg of ammonium decamolybdate, about 60 grams of $ZrO_2$ and about 500 grams of $TiO_2$.

4. A process as defined in claim 1 wherein the alloy is prepared from 100 kg of ammonium decamolybdate, 200 grams of thorium nitrate and 500 grams of $TiO_2$.

* * * * *